US006236195B1

(12) United States Patent
Nagatomo

(10) Patent No.: US 6,236,195 B1
(45) Date of Patent: May 22, 2001

(54) VOLTAGE VARIATION CORRECTION CIRCUIT

(75) Inventor: Shigeru Nagatomo, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/506,592

(22) Filed: Feb. 18, 2000

(30) Foreign Application Priority Data

Feb. 25, 1999 (JP) ..... 11-047601

(51) Int. Cl.[7] ..... G05F 5/00; G05F 3/04
(52) U.S. Cl. ..... 323/303; 323/311
(58) Field of Search ..... 323/220, 273, 323/303, 304, 311

(56) References Cited

U.S. PATENT DOCUMENTS

| | | | | |
|---|---|---|---|---|
| 2,897,430 | * | 7/1959 | Winkel | 323/220 |
| 4,602,322 | * | 7/1986 | Merrick | 363/127 |
| 4,651,264 | * | 3/1987 | Hu | 363/18 |
| 5,541,500 | * | 7/1996 | Krahl | 323/299 |

* cited by examiner

*Primary Examiner*—Matthew Nguyen
(74) *Attorney, Agent, or Firm*—Jones Volentine, L.L.C.

(57) ABSTRACT

The invention relates to a circuit for correcting variation in voltage. A voltage variation correction in this invention has an output terminal for outputting a given voltage, a transistor connected between a power supply voltage and the output terminal, a capacitor connected between a control electrode of the transistor and the output terminal and a resistor connected between the control electrode of the transistor and the power supply voltage.

16 Claims, 4 Drawing Sheets

VOLTAGE SUPPLY CIRCUIT ACCORDING TO FIRST EMBODIMENT OF THE INVENTION

VOLTAGE SUPPLY CIRCUIT
ACCORDING TO FIRST EMBODIMENT OF THE INVENTION

CONVENTIONAL VOLTAGE SUPPLY CIRCUIT

VOLTAGE SUPPLY CIRCUIT
ACCORDING TO SECOND EMBODIMENT OF THE INVENTION

VOLTAGE SUPPLY CIRCUIT
ACCORDING TO THIRD EMBODIMENT OF THE INVENTION

VOLTAGE SUPPLY CIRCUIT
ACCORDING TO FOURTH EMBODIMENT OF THE INVENTION

VOLTAGE SUPPLY CIRCUIT
ACCORDING TO FIFTH EMBODIMENT OF THE INVENTION

VOLTAGE SUPPLY CIRCUIT
ACCORDING TO SIXTH EMBODIMENT OF THE INVENTION

VOLTAGE VARIATION CORRECTION CIRCUIT

BACKGROUND OF THE INVENTION

1. Field of the Invention

The invention relates to a circuit for correcting variation in voltage (hereinafter referred to as voltage variation correction circuit).

2. Description of the Related Art

FIG. 2 shows a conventional voltage supply circuit. The voltage supply circuit has an input terminal 1 to which a reference voltage Vref is externally inputted. The input terminal 1 is connected to an operational amplifier 2 configured as a voltage follower. The input terminal 1 is connected to a non-inverting input terminal of the operational amplifier 2 while an output of the operational amplifier 2 is connected to an inverting input terminal thereof. The output of the operational amplifier 2 is connected to an output terminal 3. A load circuit 4*a* is connected between the output terminal 3 and a ground voltage GND, and a load circuit 4*b* is connected between the output terminal 3 and a power supply voltage Vdd. As a result, it impossible to supply power having the same voltage as the reference voltage Vref from the output side of the operational amplifier 2 to the load circuits 4*a*, 4*b* without requiring a power from the reference voltage Vref, which is supplied to the input terminal 1.

However, there is the following drawback in the conventional circuit. Even if loads in the load circuits 4*a*, 4*b* are varied, a voltage at the output terminal 3 need be kept constant. It is necessary to increase an output capacity of the operational amplifier 2 so as to keep the voltage at the output terminal 3 constant. If the output capacity is increased, the operational amplifier 2 always consumes much power, which prevents the conventional circuit from saving or reducing a power consumption.

SUMMARY OF THE INVENTION

To solve the foregoing problem, a typical voltage variation correction circuit of the invention has the following configuration. That is, it comprises an output terminal for outputting a given voltage, a transistor connected between a power supply voltage and the output terminal, a capacitor connected between a control electrode of the transistor and the output terminal, and a resistor connected between the control electrode of the transistor and the power supply voltage.

PREFERRED EMBODIMENT OF THE INVENTION

Figure 1:
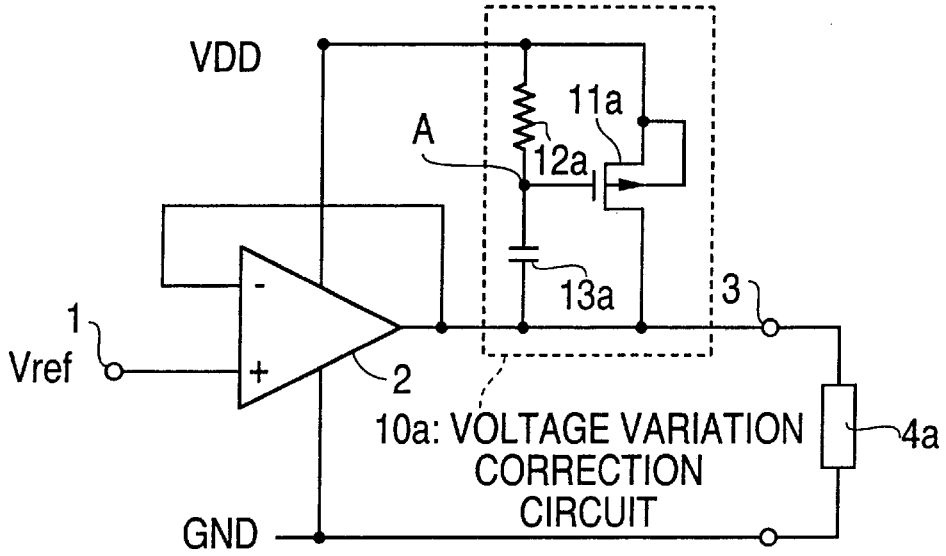
FIG. 1 is a circuit diagram of a voltage supply circuit according to a first embodiment of the invention.
Figure 2:
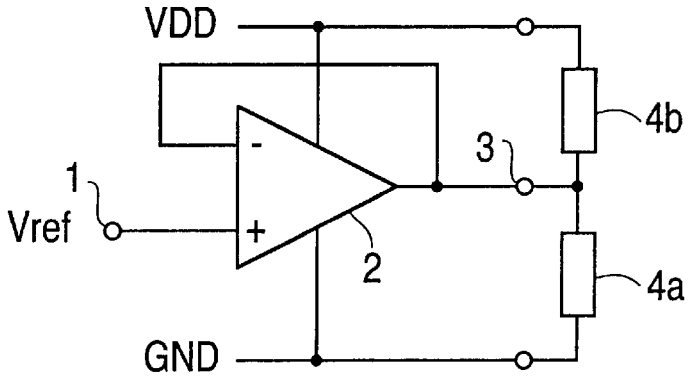
FIG. 2 (PRIOR ART)
FIG. 2 is a circuit diagram of a voltage supply circuit used in a conventional semiconductor integrated circuit.

First Embodiment (FIG. 1)

FIG. 1 is a circuit diagram of a voltage supply circuit according to a first embodiment of the invention. The voltage supply circuit of the invention comprises an input terminal 1, an operational amplifier 2, an output terminal 3, and a voltage variation correction circuit 10*a*. A reference voltage Vref is externally supplied to the input terminal 1. The input terminal 1 is connected to a non-inverting input terminal of the operational amplifier 2. An inverting input terminal of the operational amplifier 2 is connected to an output of the operational amplifier 2. The operational amplifier 2 is a voltage follower circuit. The output of the operational amplifier 2 is connected to the output terminal 3. A load circuit 4*a* serving as a circuit of a later stage is connected between the output terminal 3 and a ground voltage GND. The voltage variation correction circuit 10*a* is connected between a power supply voltage Vdd and the output terminal 3.

The voltage variation correction circuit 10*a* comprises a p-channel MOS transistor (hereinafter referred to as PMOS) 11*a*, a resistor 12*a* and a capacitor 13*a*. A source of the PMOS 11*a* is connected to the power supply voltage Vdd while a drain thereof is connected to the output terminal 3. The resistor 12*a* is connected between the power supply voltage Vdd and a gate of the PMOS 11*a*. The capacitor 13*a* is connected between the gate of the PMOS 11*a* and the output terminal 3.

The operation of the voltage supply circuit of the invention is described now.

The reference voltage Vref is supplied to the input terminal 1. A voltage which is the same as the reference voltage Vref is outputted to the output terminal 3. The operational amplifier 2 is a voltage follower circuit and it is a buffer circuit having a high input impedance and a low output impedance. This configuration is used, for example, for removing the influence between circuit configurations in respective circuit stages when a circuit stage is connected to another circuit stage.

The operational amplifier 2 supplies a load current to the load circuit 4*a*. If the current at the load circuit 4*a* is stable, a voltage at a node A (voltage at the gate of the PMOS 11*a*) of the voltage variation correction circuit 10*a* is equal to the power supply voltage Vdd. Accordingly, the PMOS 11*a* is OFF. The capacitor 13*a* is charged with a potential difference (Vdd−Vref) between the node A and the output terminal 3.

If the current at the load circuit 4*a* is stable, the voltage supply circuit keeps this state.

If the current at the load circuit 4*a* increases sharply, the voltage at the output terminal 3 decreases. Even if the voltage at the output terminal 3 decreases, the voltage between both terminals of the capacitor 13*a* is not immediately varied. Accordingly, if the voltage at the output terminal 3 decreases by ΔV, the voltage at the node A decreases to become Vdd−ΔV. Since the voltage at the gate of the PMOS 11*a* decreases, the PMOS 11*a* becomes ON. Accordingly, a part of a load current is supplied from the power supply voltage Vdd via the PMOS 11*a*. This operation causes the voltage at the output terminal 3 to increase. The voltage at the node A increases based on a time constant which is determined by a resistance R and a capacitance C of the capacitor 13*a*. If the voltage at the node A exceeds a threshold value of the PMOS 11*a*, the PMOS 11a becomes OFF. Alternatively, if the voltage at the output terminal 3 increases to reach the reference voltage Vref, the PMOS 11*a* becomes OFF.

When the current at the load circuit 4*a* decreases, there does not occur large variation in the voltage at the output terminal 3. At this time, it keeps the same state as a case where the current at the load circuit 4*a* is stable. The voltage supply circuit of the first embodiment has a voltage variation correction circuit capable of coping with the sharp increase of the load current. Even if a driving capacity of the operational amplifier 2 is not set to a large value, variation in the voltage at the output terminal 3 become small. As a result, it is possible to reduce a power consumption.

Figure 3:
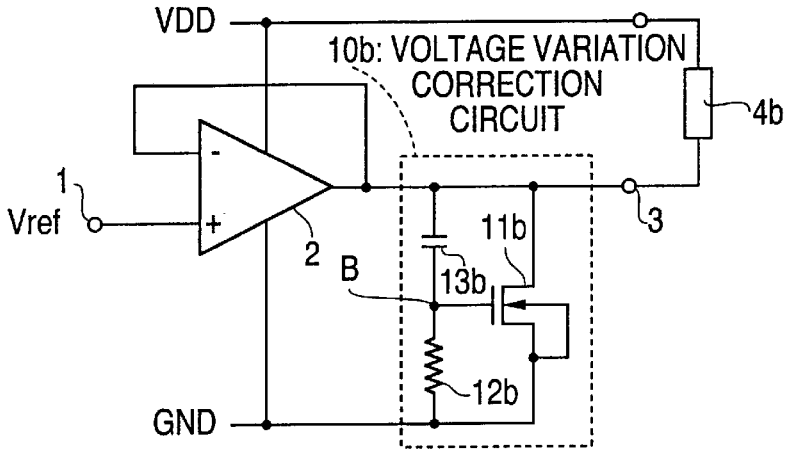
FIG. 3 is a circuit diagram of a voltage supply circuit according to a second embodiment of the invention.

Second embodiment (FIG. 3)

FIG. 3 is a circuit diagram of a voltage supply circuit according to a second embodiment of the invention.

The voltage supply circuit of the second embodiment comprises an input terminal 1, an operational amplifier 2, an output terminal 3, and a voltage variation correction circuit 10*b*. A reference voltage Vref is externally applied to the input terminal 1. The input terminal 1 is connected to a non-inverting input terminal of the operational amplifier 2. An inverting input terminal of the operational amplifier 2 is connected to an output of the operational amplifier 2. The operational amplifier 2 is a voltage follower circuit. The output of the operational amplifier 2 is connected to the output terminal 3. A load circuit 4*b* serving as a circuit of a later stage is connected between the output terminal 3 and a power supply voltage Vdd. The voltage variation correction circuit 10*b* is connected between a ground voltage GND and the output terminal 3.

The voltage variation correction circuit 10*b* comprises an n-channel MOS transistor (hereinafter referred to as NMOS) 11*b*, a resistor 12*b* and a capacitor 13*b*. A source of the NMOS 11*b* is connected to the ground voltage GND while a drain thereof is connected to the output terminal 3. The resistor 12*b* is connected between the ground voltage GND and a gate of the NMOS 11*b*. The capacitor 13*b* is connected between the gate of the NMOS 11*b* and the output terminal 3.

The operation of the voltage supply circuit of the invention is described now.

The reference voltage Vref is applied to the input terminal 1. A voltage which is the same as the reference voltage Vref is outputted to the output terminal 3. The operational amplifier 2 is a voltage follower circuit and it is a buffer circuit having a high input impedance and a low output impedance. This configuration is used, for example, for removing the influence between circuit configurations in respective circuit stages when a circuit stage is connected to another circuit stage.

The operational amplifier 2 supplies a load current to the load circuit 4*b*. If the current at the load circuit 4*b* is stable, a voltage at a node B (voltage at the gate of the NMOS 11*b*) of the voltage variation correction circuit 10*b* is equal to the ground voltage GND. Accordingly, the NMOS 11*b* is OFF. The capacitor 13*b* is charged with a potential difference (Vref) between the node B and the output terminal 3.

If the current at the load circuit 4*b* is stable, the voltage supply circuit keeps this state.

If the current at the load circuit 4*b* increases sharply, the voltage at the output terminal 3 increases. Even if the voltage at the output terminal 3 increases, the voltage between both terminals of the capacitor 13*b* is not immediately varied. Accordingly, if the voltage at the output terminal 3 increases to become Vref+ΔV, the voltage at the node B increases to become ΔV. Since the voltage at the gate of the NMOS 11*b* increases, the NMOS 11*b* becomes ON. Accordingly, a part of a load current is supplied to the ground voltage GND via the NMOS 11*b*. This operation causes the voltage at the output terminal 3 to decrease. The voltage at the node B decreases based on a time constant which is determined by resistance R and a capacitance C of the capacitor 13*b*. If the voltage at the node B becomes not more than a threshold value of the NMOS 11*b*, the NMOS 11*b* becomes OFF. Alternatively, if the voltage at the output terminal 3 decreases to reach the reference voltage Vref, the NMOS 11*b* becomes OFF.

When the current at the load circuit 4*b* decreases, there does not occur large variation in the voltage at the output terminal 3. At this time, it keeps the same state as a case where the current at the load circuit 4*b* is stable.

The voltage supply circuit of the second embodiment has a voltage variation correction circuit capable of coping with the sharp increase of the load current. Even if a driving capacity of the operational amplifier 2 is not set to a large value, variation in voltage at the output terminal 3 becomes small. As a result, it is possible to reduce a power consumption.

Figure 4:
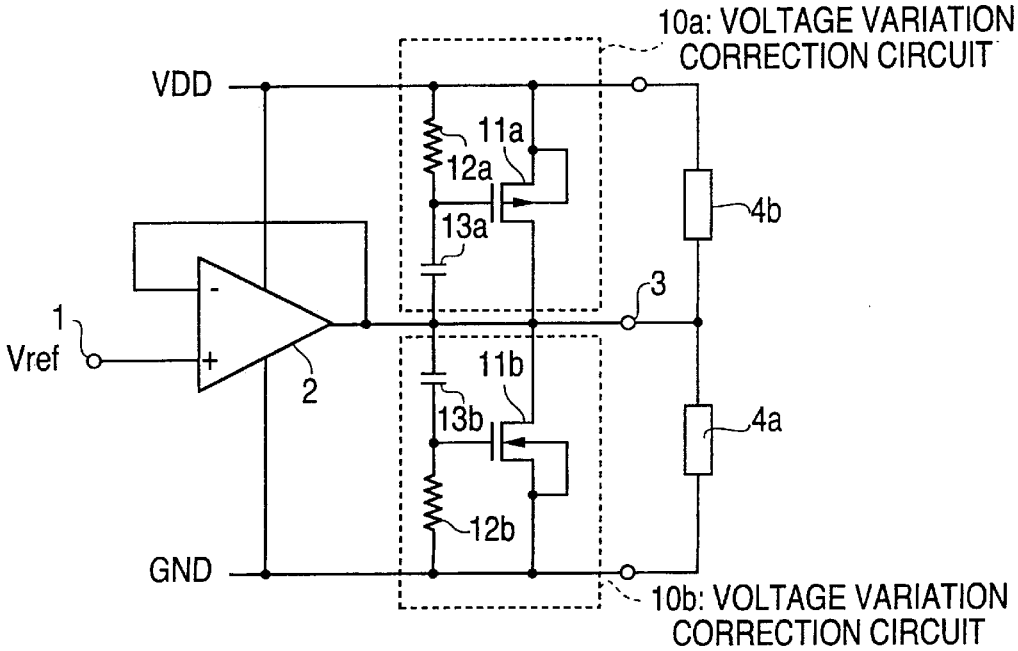
FIG. 4 is a circuit diagram of a voltage supply circuit according to a third embodiment of the invention.

Third Embodiment (FIG. 4)

FIG. 4 is a circuit diagram of a voltage supply circuit according to a third embodiment of the invention, wherein components which are common to those of the first and second embodiments shown in FIGS. 1 and 3 are denoted by the common reference numerals.

The voltage supply circuit supplies a reference voltage Vref to a load circuit 4*b* connected between a power supply voltage Vdd and an output terminal 3 and to a load circuit 4*a* connected between the output terminal 3 and a ground voltage GND.

In the voltage supply circuit according to the third embodiment, a voltage variation correction circuit 10*a*, which is the same as that shown in FIG. 1, is provided between the power supply voltage Vdd and the output terminal 3, and a voltage variation correction circuit 10*b*, which is the same as that shown in FIG. 3, is provided between the output terminal 3 and the ground voltage GND.

The operations of the respective voltage variation correction circuits 10*a*, 10*b* are the same as those which are explained in the first and second embodiments so as to suppress variation in the voltage at the output terminal 3 for coping with a sharp increase of the load current at the load circuits 4*a*, 4*b*, thereby bringing about the same effect as the first embodiment.

Figure 5:
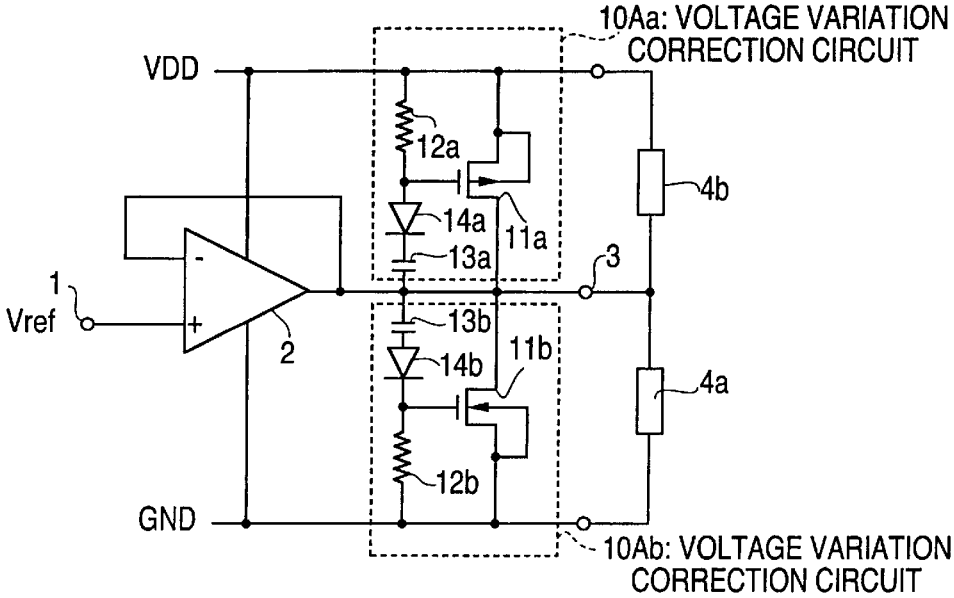
FIG. 5 is a circuit diagram of a voltage supply circuit according to a fourth embodiment of the invention.

Fourth Embodiment (FIG. 5)

FIG. 5 is a circuit diagram of a voltage supply circuit according to a fourth embodiment of the invention, wherein components which are common to those of the third embodiment shown in FIG. 4 are denoted by the common reference numerals.

The voltage supply circuit has voltage variation correction circuits 10A*a*, 10A*b* instead of the voltage variation correction circuits 10*a*, 10*b* as shown in FIG. 4 wherein the former is slightly different from the latter in the configuration.

The voltage variation correction circuit 10A*a* has a diode 14*a* which is added to and serially connected to a capacitor 13*a* in a forward direction. The voltage variation correction circuit 10A*b* has a diode 14*b* which is added to and serially connected to a capacitor 13*b* in a forward direction. Other configuration of the fourth embodiment is the same as the third embodiment shown in FIG. 4.

In the voltage variation correction circuit 10A*a* having the foregoing configuration, if the voltage at the output terminal 3 decreases due to a sharp increase of the load current at the load circuit 4*a*, the voltage between both terminals of the capacitor 13*a* is not immediately varied, so that the voltage at a gate of the PMOS 11*a* decreases. When the voltage at the gate decreases, the PMOS 11*a* becomes ON, so that a part of the load current is supplied from the power supply voltage Vdd to the load circuit 4*a* via the PMOS 11*a*. Further, the capacitor 13*a* is charged via a resistor 12*a* and the diode 14*a*, so that the voltage at the gate of the PMOS 11*a* increases with a given time constant. If the voltage at the gate of the PMOS 11*a* exceeds a threshold voltage Vt, the PMOS 11*a* becomes OFF to return to the original state.

Since the capacitor 13*a* is charged via the resistor 12*a* and the diode 14*a* in the voltage variation correction circuit 10A*a*, even if impulse noises are overlaid with one another as the voltage at the output terminal 3 varies, the PMOS 11*a* becomes ON continuously for a given time without being affected by these noises, so that a part of the load current is reliably supplied to the load circuit 4*a*. Even if the voltage at the output terminal 3 increases due to the increase of the load current at the load circuit 4*b*, variation in the voltage at the output terminal 3 is suppressed similarly by the voltage variation correction circuit 10A*b*.

As mentioned in detail above, the voltage supply circuit of the fourth embodiment has the voltage variation correction circuit 10A*a*, 10A*b* capable of supplying the load current by the amount of increase thereof for a given time of period even if there occurs variation in the voltage at the output terminal 3 as well as the occurrence of impulse noises. As a result, there is an effect that variation in the voltage can be reliably suppressed without being affected by the impulse noises in addition to the same effect as the first embodiment.

Figure 6:
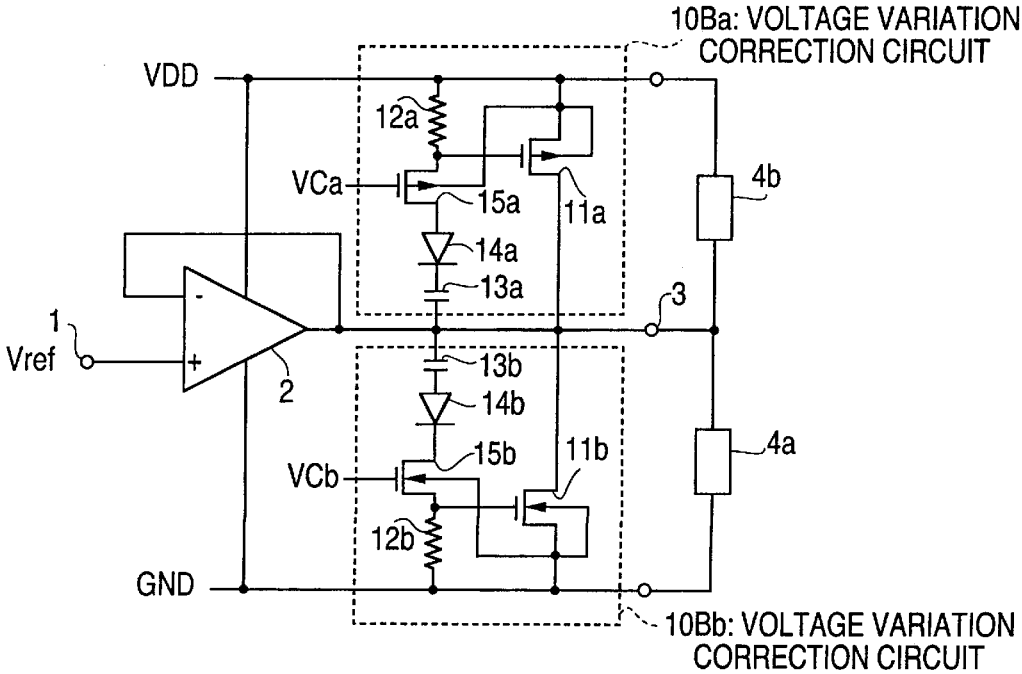
FIG. 6 is a circuit diagram of a voltage supply circuit according to a fifth embodiment of the invention.

Fifth Embodiment (FIG. 6)

FIG. 6 is a circuit diagram of a voltage supply circuit according to a fifth embodiment of the invention, wherein components which are common to those of the fourth embodiment shown in FIG. 5 are denoted by the common reference numerals.

The voltage supply circuit has voltage variation correction circuits 10B*a*, 10B*b* instead of the voltage variation correction circuits 10A*a*, 10A*b* as shown in FIG. 5 wherein the former is slightly different from the latter in the configuration.

The voltage variation correction circuit 10B*a* has a PMOS 15*a* for switching purposes which is added to and serially connected to a capacitor 13*a* and a diode 14*a*. The voltage variation correction circuit 10B*b* has an NMOS 15*b* for switching purposes which is added to and serially connected to a capacitor 13*b* and a diode 14*b*. Other configuration of the fifth embodiment is the same as the fourth embodiment shown in FIG. 5.

In the voltage variation correction circuit 10B*a* of the fifth embodiment, if a control voltage VCa of H level is applied to a gate of the PMOS 15*a*, the operation of the voltage variation correction circuit 10B*a* can be stopped. If a control voltage VCb of L level is applied to a gate of the NMOS 15*b*, the operation of the voltage variation correction circuit 10B*b* can be stopped.

As a result, the operations of the voltage variation correction circuits 10B*a*, 10B*b* can be stopped by the control voltages VCa, VCb at the time immediately after turning on the power supply or at the time when the voltage variation correction function is intended to be stopped.

As mentioned in detail above, since the voltage supply circuit of the fifth embodiment has the PMOS 15*a* and NMOS 15*b* for switching purposes to control the voltage variation correction function, it has an effect to stop the voltage variation correction function, if need be, in addition to the same effect as the fourth embodiment.

Figure 7:
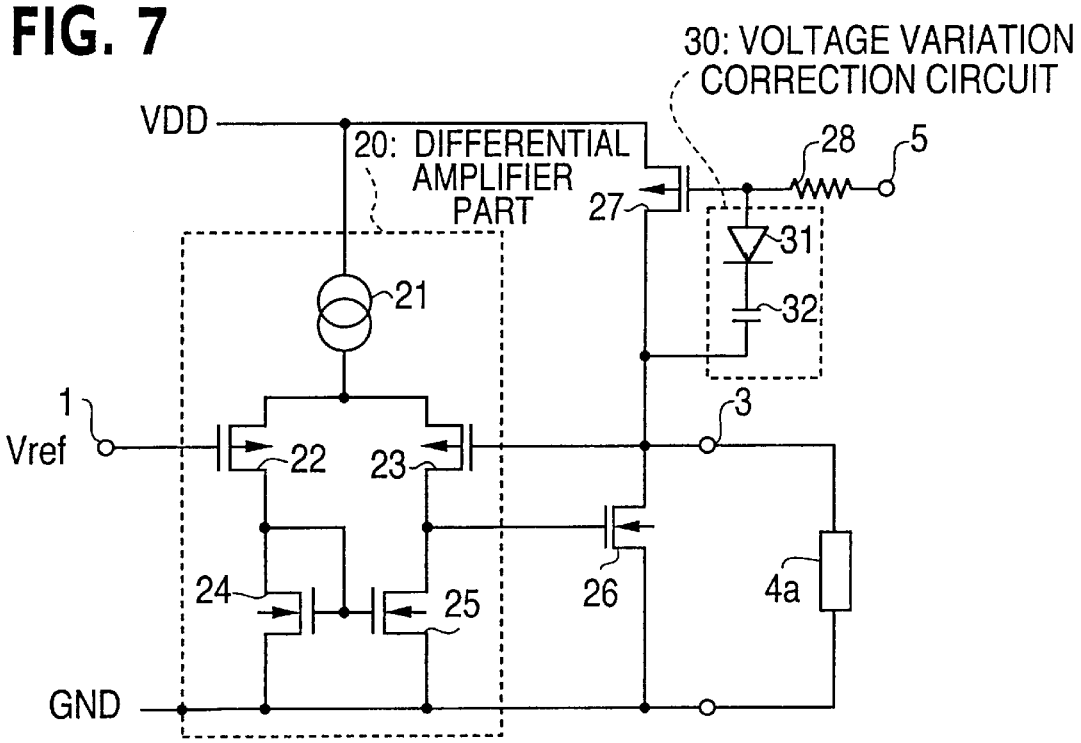
FIG. 7 is a circuit diagram of a voltage supply circuit according to a sixth embodiment of the invention.

Sixth Embodiment (FIG. 7)

FIG. 7 is a circuit diagram of a voltage supply circuit according to a sixth embodiment of the invention, wherein components which are common to those of the first embodiment shown in FIG. 1 are denoted by the common reference numerals.

The voltage supply circuit of the sixth embodiment supplies a constant voltage to a load circuit 4*a* connected between an output terminal 3 and a ground voltage GND, and it has an input terminal 1 to which a reference voltage Vref is applied. The voltage supply circuit has a differential amplifier part 20 configured by a constant current source 21, PMOSs 22, 23 and NMOSs 24, 25. An input side of the constant current source 21 is connected to a power supply voltage Vdd and an output side thereof is connected commonly to sources of PMOSs 22, 23. Gates of the PMOSs 22, 23 form a non-inverting input terminal and an inverting input terminal of the differential amplifier part 20, and the gate of the PMOS 22 is connected to the input terminal 1.

A drain of the PMOS 22 is connected to a drain of the NMOS 24 while a source of the NMOS 24 is connected to the ground voltage GND. A drain of the PMOS 23 is connected to a drain of the NMOS 25 while a source of the NMOS 25 is connected to the ground voltage GND. Gates of the NMOSs 24, 25 are commonly connected to the drain of the PMOS 22 so that an output signal of the differential amplifier part 20 is outputted from the drain of the PMOS 23.

The drain of the PMOS 23 is connected to a gate of an operation transistor (e.g., an operation MOS transistor, hereinafter referred to as operation MOS) 26. A source of the operation MOS 26 is connected to the ground voltage GND while a drain thereof is connected to the output terminal 3. A drain of a load transistor (e.g., a load MOS transistor, hereinafter referred to as load MOS) 27 is connected to the output terminal 3 while a source thereof is connected to the power supply voltage Vdd. A gate of the load MOS 27 is connected to a control terminal 5 via a resistor 28 so that a control voltage for controlling a load current is externally applied to the control terminal 5. Further, the output terminal 3 is connected to an inverting input terminal of the differential amplifier part 20, i. e., to the gate of the PMOS 23 wherein the differential amplifier part 20, the operation MOS 26 and the load MOS 27 configure a voltage follower. With this configuration, an output voltage which is equal to the reference voltage Vref applied to the input terminal 1 is outputted from the output terminal 3.

Further, the voltage supply circuit of the sixth embodiment has a voltage variation correction circuit 30 for suppressing variation in an output voltage outputted from the output terminal 3. The voltage variation correction circuit 30 comprises a diode 31 and a capacitor 32 wherein a positive electrode of the diode 31 is connected to the gate of the load MOS 27. A negative electrode of the diode 31 is connected to one terminal of the capacitor 32 and the output terminal 3 is connected to the other terminal of the capacitor 32.

The operation of suppressing variation in the output voltage by the diode 31 and capacitor 32 of the voltage variation correction circuit 30 is the same as that by the diode 14*a* and the capacitor 13*a* of the voltage variation correction circuit 10A*a* in FIG. 5.

As mentioned in detail above, the voltage supply circuit of the sixth embodiment adds the voltage variation correction circuit 30 between the gate of the load MOS 27 which is a constituent of the voltage follower and the output terminal 3. Accordingly, it is possible to obtain the same effect as the fourth embodiment by the voltage variation correction circuit 30 having such a simple configuration.

What is claimed is:

1. A voltage variation correction circuit comprising:

an output terminal that outputs a given voltage;

a transistor connected between a power supply voltage and the output terminal;

a capacitor between a control electrode of the transistor and the output terminal;

a resistor connected between the control electrode of the transistor and the power supply voltage; and a diode connected in series to the capacitor between the power supply voltage and the output terminal.

2. The voltage variation correction circuit according to claim 1, further comprising a switch which is connected in series to the diode between the power supply voltage and output terminal.

3. A voltage variation correction circuit comprising:

an operation transistor which operates in response to an output of an operational amplifier;

a load transistor connected between the operation transistor and a power supply voltage;

an output terminal connected between the operation transistor and the load transistor;

a diode connected between the output terminal and a control electrode of the load transistor; and a capacitor connected in series to the diode between the output terminal and the control electrode of the load transistor.

4. A reference voltage supply circuit comprising:

an input terminal having a reference voltage applied thereto;

an operational amplifier having a first input terminal, a second input terminal and an output terminal, the first input terminal being connected to said input terminal and the output terminal being connected to the second input terminal, said operational amplifier being connected between first and second voltage sources; and a first voltage variation correction circuit connected between output terminal of said operational amplifier and the first voltage source, said first voltage variation correction circuit including a first capacitor having a first terminal connected to the output terminal of said operational amplifier and having a second terminal, a first resistor having a first terminal connected to the second terminal of the first capacitor and having a second terminal connected to the first voltage source, and a first transistor having a gate connected to the first terminal of the first resistor, a source connected to the first voltage source and a drain connected to the output terminal of said operational amplifier.

5. The reference voltage supply circuit according to claim 4, further comprising:

a second voltage variation correction circuit connected between the output terminal of said operational amplifier and the second voltage source, said second voltage variation correction circuit including a second capacitor having a first terminal connected to the output terminal of said operational amplifier and having a second terminal, a second resistor having a first terminal connected to the second terminal of the second capacitor and having a second terminal connected to the second voltage source, and a second transistor having a gate connected to the first terminal of the second resistor, a source connected to the second voltage source and a drain connected to the output terminal of said operational amplifier.

6. The reference voltage supply circuit according to claim 4, wherein the first transistor further has a back gate connected to the source of the first transistor.

7. The reference voltage supply circuit according to claim 5, wherein the second transistor further has a back gate connected to the source of the second transistor.

8. The reference voltage supply circuit according to claim 4, further comprising a first diode connected between the second terminal of the first capacitor and the first terminal of the first resistor.

9. The reference voltage supply circuit according to claim 5, further comprising a second diode connected between the second terminal of the second capacitor and the first terminal of the second resistor.

10. The reference voltage supply circuit according to claim 8, further comprising a third transistor connected between the first diode and the first resistor, the third transistor having a gate receiving a first control signal.

11. The reference voltage supply circuit according to claim 9, further comprising a fourth transistor connected between the second diode and the second resistor, the fourth transistor having a gate receiving a second control signal.

12. The reference voltage supply circuit according to claim 10, wherein the third transistor further has a back gate connected to the source of the first transistor.

13. The reference voltage supply circuit according to claim 11, wherein the fourth transistor further has a back gate connected to the source of the second transistor.

14. A reference voltage supply circuit comprising:

an input terminal having a reference voltage applied thereto;

a differential amplifier having a first input terminal, a second input terminal and an output terminal, the first input terminal being connected to said input terminal and said differential amplifier being connected between first and second voltage sources;

an operational MOS transistor having a source connected to the first voltage source, a drain connected to the second input terminal of said differential amplifier and a gate connected to the output terminal of said differential amplifier;

a load MOS transistor having a source connected to the second voltage source, a drain connected to the second input terminal of said differential amplifier and a gate having a control voltage applied thereto; and a voltage variation correction circuit including a capacitor having a first terminal connected to the second input terminal of said differential amplifier and having a second terminal, and a diode having an output terminal connected to the second terminal of the capacitor and having an input terminal coupled to the control voltage.

15. The reference voltage supply circuit according to claim 14, further comprising a resistor, the control voltage being applied to both the gate of said load MOS transistor and the input terminal of the diode through the resistor.

16. The reference voltage supply circuit according to claim 14, wherein said differential amplifier comprises:

a constant current source connected to the second voltage source;

a first MOS transistor having a source, a drain and a gate, the source of said first MOS transistor being connected to said constant current source and the gate of said first MOS transistor being connected to said input terminal having the reference voltage applied thereto;

a second MOS transistor having a source, a drain and a gate, the source of said second MOS transistor being connected to said constant current source and the gate of said second MOS transistor being connected to the second input terminal of said differential amplifier;

a third MOS transistor having a drain and a gate commonly connected to the drain of said first MOS transistor and having a source connected to the first voltage source; and a fourth MOS transistor having a drain connected to the drain of said second MOS transistor, a gate connected to the gate of said third MOS transistor and a source connected to the output terminal of said differential amplifier.

* * * * *